US007030342B2

(12) United States Patent
McWilliams

(10) Patent No.: US 7,030,342 B2
(45) Date of Patent: Apr. 18, 2006

(54) ELECTRICAL HEATING ASSEMBLY

(75) Inventor: Kevin Ronald McWilliams, Stratford Upon Avon (GB)

(73) Assignee: Ceramaspeed Limited, (GB)

( * ) Notice: Subject to any disclaimer, the term of this patent is extended or adjusted under 35 U.S.C. 154(b) by 0 days.

(21) Appl. No.: 10/507,977

(22) PCT Filed: Mar. 10, 2003

(86) PCT No.: PCT/GB03/01016

§ 371 (c)(1),
(2), (4) Date: Sep. 15, 2004

(87) PCT Pub. No.: WO03/081952

PCT Pub. Date: Oct. 2, 2003

(65) Prior Publication Data

US 2005/0115949 A1 Jun. 2, 2005

(30) Foreign Application Priority Data

Mar. 22, 2002 (GB) ..... 0206738

(51) Int. Cl.
*H05B 3/68* (2006.01)

(52) U.S. Cl. ..... 219/460.1; 219/458.1; 219/459.1; 219/461.1; 219/462.1; 219/465.1; 219/466.1; 219/468.1

(58) Field of Classification Search ..... 219/458.1, 219/459.1, 460.1, 461.1, 462.1, 463.1, 464.1, 219/465.1, 466.1, 467.7, 468.1, 468.2
See application file for complete search history.

(56) References Cited

U.S. PATENT DOCUMENTS 4,538,051 A * 8/1985 Schreder et al. ..... 219/457.1
5,823,680 A * 10/1998 Kato et al. ..... 374/185

FOREIGN PATENT DOCUMENTS

EP 0810814 12/1997

OTHER PUBLICATIONS

International Search Report Aug. 20, 2003.

* cited by examiner

*Primary Examiner*—Shawntina Fuqua
(74) *Attorney, Agent, or Firm*—Ira S. Dorman

(57) ABSTRACT

An electrical heating assembly (2) comprises a glass-ceramic cooking plate (4) having an upper surface (6) for receiving a cooking vessel (8) and a lower surface (10). A radiant electric heater (12) incorporating at least one electric heating element (20) is supported in contact with the lower surface of the cooking plate. Temperature sensing means (29) is spaced above the at least one heating element (20). The temperature sensing means includes a support member (33) which has provided on an upper surface a film form temperature-sensitive electrical resistance element (30) and which is provided with electrical connecting leads (34). Thermal insulation means (40) is adapted and arranged to shield the support member (33) and a corresponding region of the lower surface (10) of the cooking plate (4) from direct thermal radiation from the at least one electric heating element (20).

35 Claims, 2 Drawing Sheets

ELECTRICAL HEATING ASSEMBLY

Figure 1:
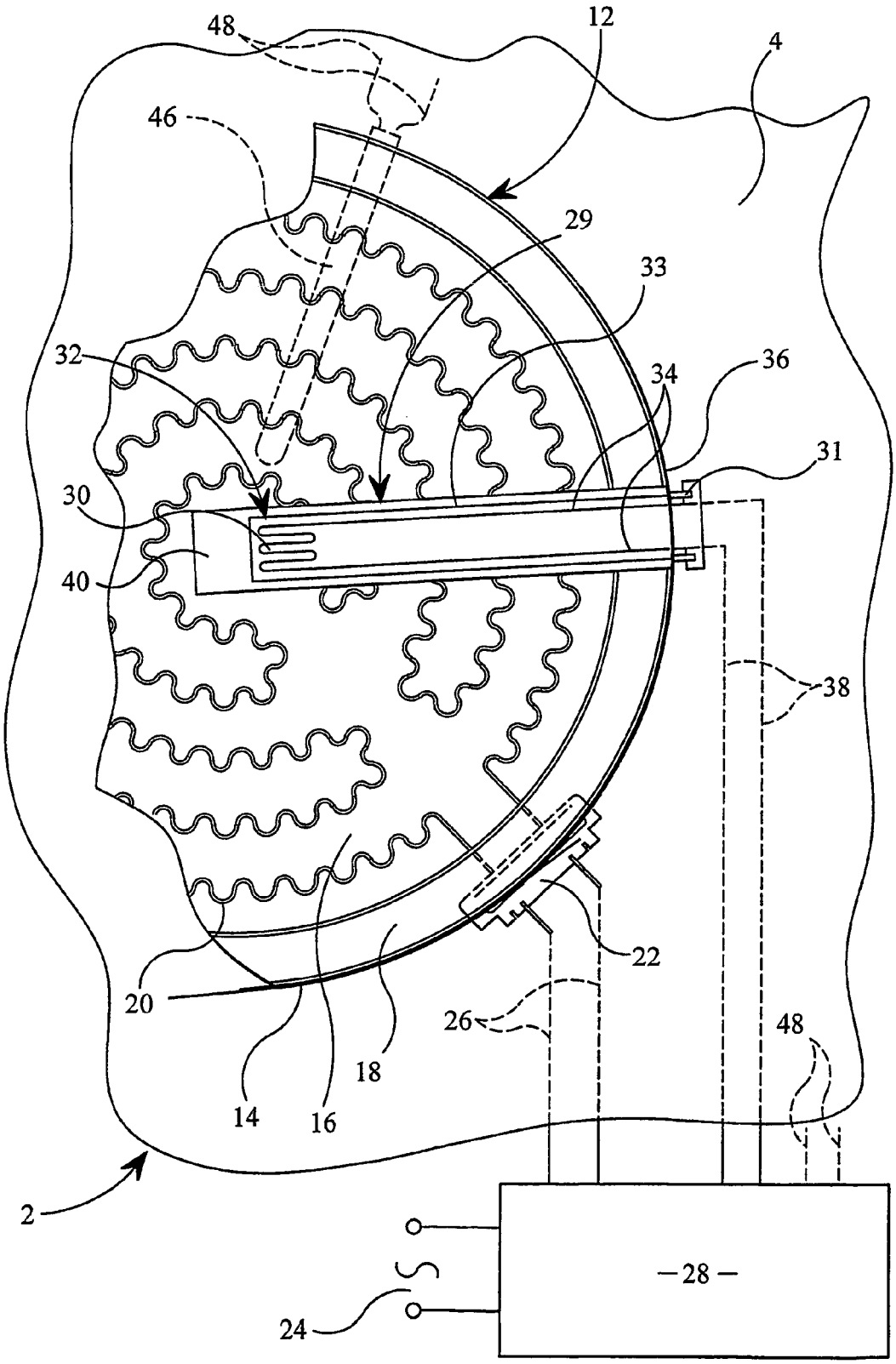

This invention relates to an electrical heating assembly for a cooking appliance, in which a glass-ceramic cooking plate has an upper surface for receiving a cooking vessel and a lower surface having supported in contact therewith a radiant electric heater incorporating at least one electric heating element.

It is well known to provide such an electrical heating assembly for a cooking appliance in which a temperature sensing device is arranged under the glass-ceramic cooking plate in order to monitor the temperature of the glass-ceramic cooking plate and to operate to de-energise the one or more heating elements in the heater under the glass-ceramic cooking plate when a particular temperature is reached, in order to prevent thermal damage to the cooking plate.

Requirements exist for sensing the temperature of a cooking vessel located on the upper surface of the glass-ceramic cooking plate, using a temperature sensing device provided underneath the cooking plate. A problem is encountered in that the high temperature of the glass-ceramic cooking plate between the sensing device and the cooking vessel influences the measurement. If the temperature of the glass-ceramic in this region is too high, this prevents any sensing of a lower temperature of the overlying cooking vessel. Furthermore, the high temperature effect on the sensing device of direct thermal radiation from the one or more heating elements in the underlying radiant heater also prevents the sensing device from sensing the temperature of the cooking vessel.

It is known to provide what is referred to as a 'cool patch' of the glass-ceramic cooking plate within a heated area by an arrangement in which a discrete temperature sensing device surrounded by a thermally insulating enclosure is urged directly against a region of the lower surface of the glass-ceramic cooking plate, to sense a change in temperature of the cooking plate produced by an overlying cooking vessel conducting heat back into the cooking plate in that area. Such a discrete temperature sensing device has been provided of capillary or electromechanical form, or of platinum resistance temperature detector form, urged against the lower surface of the glass-ceramic cooking plate such as by spring loading means. Such an arrangement is bulky and expensive to implement.

It is an object of the present invention to overcome or minimise this problem.

According to the present invention there is provided an electrical heating assembly comprising:

a glass-ceramic cooking plate having an upper surface for receiving a cooking vessel and a lower surface;

a radiant electric heater incorporating at least one electric heating element, the heater being supported in contact with the lower surface of the cooking plate; and temperature sensing means spaced above the at least one heating element, the temperature sensing means comprising:

a support member having provided on an upper surface thereof so as to contact the lower surface of the cooking plate a temperature-sensitive electrical resistance element of film form and provided with electrical connecting leads; and thermal insulation means adapted and arranged to shield the support member and a corresponding region of the lower surface of the cooking plate from direct thermal radiation from the at least one electric heating element.

The support member may comprise a high-temperature resistant material, for example a ceramic material such as alumina or cordierite.

The support member may extend from a periphery of the heater towards a central region thereof. In such a case, the electrical connecting leads may be arranged to extend from the film form temperature-sensitive electrical resistance element at least to a peripheral region of the radiant electric heater.

Alternatively, the support member may be provided in a central region of the heater, for example supported from below.

The electrical connecting leads may be arranged for electrical connection to circuit means. The circuit means may be adapted to monitor electrical resistance of the film form temperature-sensitive electrical resistance element as a function of temperature of the lower surface of the cooking plate with which it is in contact and hence as a function substantially of temperature of a cooking vessel located on the upper surface of the cooking plate and overlying the shielded region.

The electrical connecting leads may be of film form and may be provided on the upper surface of the support member.

The film form temperature-sensitive electrical resistance element and/or the electrical connecting leads may be of thick film form. In such a case, the electrical connecting leads and/or the film temperature-sensitive electrical resistance element, may be screen-printed and fired onto the upper surface of the support member.

The thick film temperature-sensitive electrical resistance element and/or the electrical connecting leads may comprise an electrically conductive phase selected from platinum, gold, silver, palladium, nickel and alloys thereof.

Alternatively, the film form temperature-sensitive electrical resistance element and/or the electrical connecting leads may be of thin film form. In such a case a film of suitable metallic material, such as platinum, may be provided on the support member by sputtering.

The thermal insulation means may be of pad or block form in contact with the support member and may be provided with a shallow recess for accommodating the support member.

The thermal insulation means may be secured to, or held in contact with, the support member.

The thermal insulation means may be selected from vermiculite, microporous, ceramic fibre and calcium silicate materials.

The thermal insulation means may have an external surface provided with a layer of thermal radiation-reflecting material.

The radiant electric heater may comprise a dish-like support accommodating the at least one electric heating element and having a peripheral wall of thermal insulation material contacting the lower surface of the glass-ceramic cooking plate. The support member, where it extends from the periphery of the heater, may pass through a recess formed in the upper surface of the peripheral wall. In such a case, the support member may be secured to the dish-like support, for example by way of a mounting bracket secured to a side of the dish-like support.

If desired, an electrically insulating or passivation layer, such as of film form, may be provided on the upper surface of the support member.

A temperature-responsive means may additionally be provided to sense temperature of a region of the glass-ceramic cooking plate subjected to direct thermal radiation from the at least one electric heating element of the radiant electric heater and adapted to de-energise the at least one electric heating element when a predetermined maximum operating temperature is reached by the cooking plate.

By means of the present invention a region is provided on the cooking plate in the form of a relatively cool patch having a lower temperature than the surrounding regions of the glass-ceramic cooking plate. The temperature of this cool patch region is monitored by the film form temperature-sensitive electrical resistance element deposited on the support member. Heat from an overlying cooking vessel is conducted into this region of the cooking plate and the film form element is therefore able to monitor the temperature of the cooking vessel and provide temperature control in a cooking function known in the art as an autocook function.

Because the film form temperature-sensitive element is not subjected to direct radiation from the at least one electric heating element, the materials from which the film form element is constructed need not have a very high temperature-withstanding capability and can consequently be relatively inexpensive.

Figure 2:
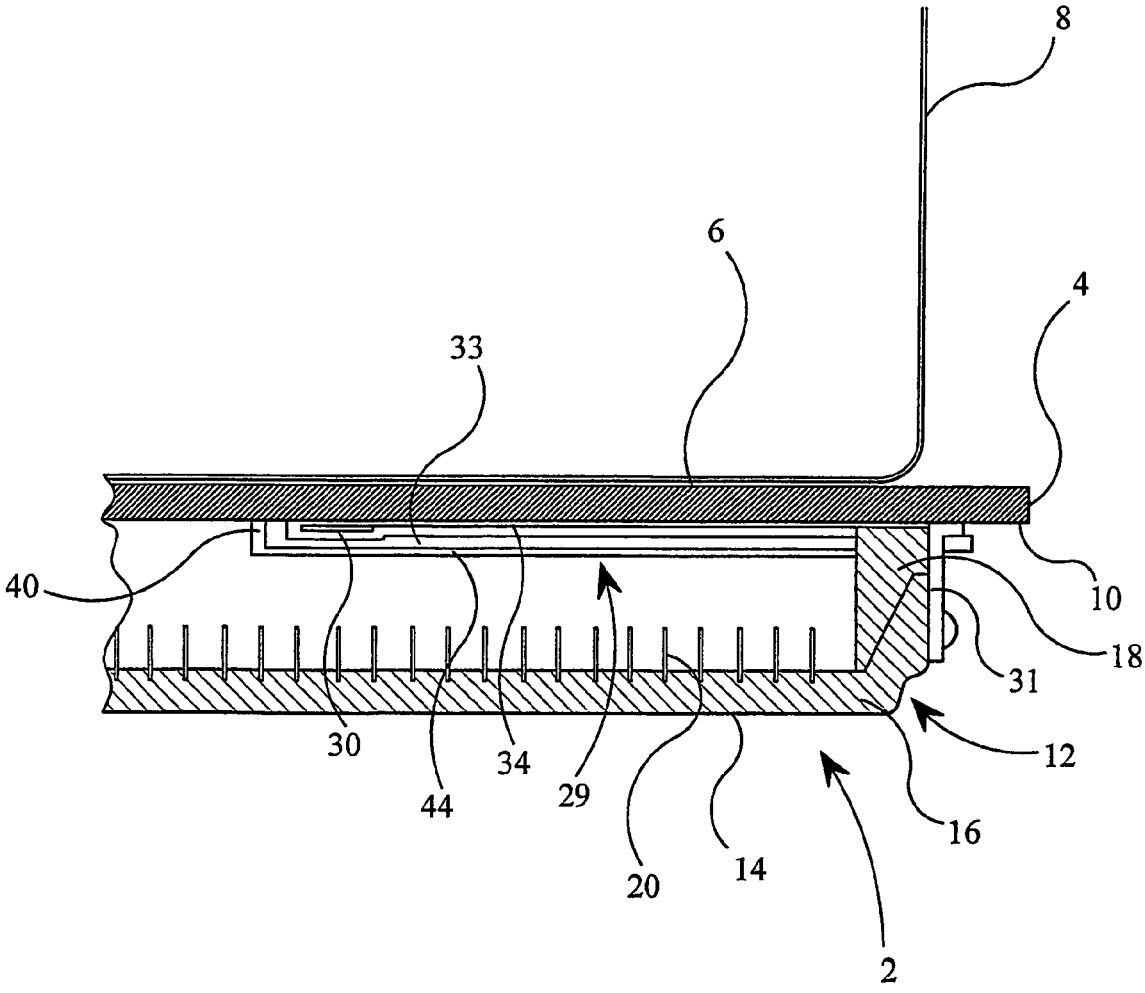

For a better understanding of the present invention and to show more clearly how it may be carried into effect, reference will now be made, by way of example, to the accompanying drawings in which:

FIG. 1 is a top plan view of an embodiment of an electrical heating assembly according to the present invention; and FIG. 2 is a cross-sectional view of the assembly of FIG. 1.

Referring to the drawings, an electrical heating assembly 2 comprises a glass-ceramic cooking plate 4 of well-known form, having an upper surface 6 for receiving a cooking vessel 8. A lower surface 10 of the cooking plate 4 has a radiant electric heater 12 supported in contact therewith. The radiant electric heater 12 comprises a metal dish-like support 14 in which is provided a base layer 16 of thermal and electrical insulation material, such as microporous thermal and electrical insulation material. A peripheral wall 18 of thermal insulation material is arranged to contact the lower surface 10 of the cooking plate 4.

At least one radiant electric heating element 20 is supported relative to the base layer 16. The heating element or elements 20 can comprise any of the well-known forms of heating element, such as wire, ribbon, foil or lamp forms, or combinations thereof. As particularly shown in FIGS. 1 and 2, the heating element or elements 20 can be of corrugated ribbon form, supported edgewise on the base layer 16 of insulation material.

A terminal block 22 is provided at an edge region of the heater 12, for connecting the heating element or elements 20 to a power supply 24 by way of leads 26 and through a control means 28, which may be a microprocessor-based control arrangement.

The cooking vessel 8 is heated by means of direct thermal radiation from the heating element or elements 20 on the cooking plate 4 and as a result of which the cooking plate may reach temperatures as high as 700 degrees Celsius.

For many cooking operations, such as frying, it is required to provide what is commonly referred to as an autocook facility in which the actual temperature of the cooking vessel 8 is monitored and the heater 12 is appropriately controlled. As illustrated in FIGS. 1 and 2 this is achieved by providing a temperature sensing device 29 which extends from the periphery of the heater towards a central region thereof. In an alternative embodiment (not shown), the temperature sensing device 29 may be provided in a central region of the heater, for example supported from below. As shown, the temperature sensing device 29 extends across the peripheral wall 18 and the metal dish 14, preferably by way of a recess formed in the upper surface thereof, and is secured by suitable means such as a mounting bracket 31 which is shown secured to the side of the metal dish 14 and engaging with an end region of the temperature sensing device 29.

The temperature sensing device 29 comprises a support member 33 made of a suitable high-temperature resistant, electrically insulating material, for example a ceramic material such as alumina or cordierite. A film form temperature-sensitive electrical resistance element 30 is provided on the upper surface of a region 32 of the support member 31 such that, in use, the cooking vessel 8 overlies the film form element 30. The film form element 30 is provided with electrical connecting leads 34, which may also be of similar film form provided on the upper surface of the support member 33. In the illustrated embodiment, such electrical connecting leads 34 are arranged to extend at least to a peripheral region 36 of the heater 12. The connecting leads 34 are further connected by leads 38 to the control means 28.

The film form temperature-sensitive electrical resistance element 30 may be, for example, of thick film form or of thin film form.

When the film form temperature-sensitive electrical resistance element 30 and the connecting leads 34 are of thick film form, they are suitably screen-printed and fired onto the upper surface of the support member 33. The thick film element 30 and connecting leads 34 are subjected to relatively low temperatures because they are shielded from direct radiation from the heating element or elements 20 by a block or pad 40 of thermal insulation material to be described in more detail hereinafter. Relatively inexpensive thick film materials can therefore be employed for the element 30 and connecting leads 34, although a wide range of materials could be selected. Suitable thick film materials may comprise an electrically conductive phase selected, for example, from platinum, gold, silver, palladium and nickel and alloys thereof. The electrically conductive phase must, of course, provide an electrical resistance which changes satisfactorily as a function of temperature.

When the film form temperature-sensitive electrical resistance element 30 and the connecting leads 34 are of thin film form, they are suitably provided by sputtering platinum or like material onto the upper surface of the support member 33.

If desired, an electrically insulating or passivation layer (not shown), such as of film form, may be provided on the upper surface of the support member 33 covering the thick film element 30 and the connecting leads 34.

In order to shield the support member 33 from direct thermal radiation from the heating element or elements 20, the temperature sensing device further comprises an elongate block or pad 40 of thermal insulation material arranged in contact with the lower surface 10 of the cooking plate 4. The block or pad 40 is arranged immediately beneath and covering the support member 33 and is formed with a shallow recess so as to accommodate and shield the sides of the support member from direct radiation from the heating element or elements. The block or pad 40 is relatively thin, about 4 to 7 mm, for example 5 mm, and is spaced above the heating element or elements 20 so as to provide an air gap between the heating element or elements and the underside of the block or pad 40. In this way the block or pad does not affect the heat output of the heating element or elements. Thus, the block or pad 40 is also spaced above the base layer 16 of thermal and electrical insulation material. The block or pad 40 may comprise any thermal insulation material capable of withstanding the high temperatures encountered inside the heater 12. Examples of suitable thermal insulation materials are vermiculite, microporous, ceramic fibre and calcium silicate materials. The block or pad 40 may also be provided on its external surface 44 with a layer of thermal radiation-reflecting material. The block or pad 40 may be secured to the support member 33 by means of a suitable high-temperature-withstanding adhesive material, or may be held in contact with the support member by being clamped at an end region thereof between the peripheral wall 18 of the heater 12 and the lower surface 10 of the cooking plate 4.

The block or pad 40 results in a relatively cool patch in the region of the glass-ceramic cooking plate 4 above the temperature sensing device 29. Heat from the heated cooking vessel 8 is therefore able to be conducted through this region of the cooking plate and the film form temperature-sensitive electrical resistance element 30 senses changes in temperature in this region. Accordingly, the film form element 30 is able to monitor the temperature of the cooking vessel 8 and to appropriately control energising of the heating element or elements 20 by way of the control means 28.

A well-known form of temperature-responsive means 46 is suitably additionally provided in the heater 12 and connected by lead wires 48 to the control means 28. Such temperature-responsive means 46 is arranged to sense the temperature of a region of the glass-ceramic cooking plate 4 subjected to direct thermal radiation from the heating element or elements 20 and to de-energise the heating element or elements 20 when a predetermined maximum operating temperature is reached by the cooking plate 4, thereby preventing thermal damage to the material of the cooking plate 4.

The invention claimed is:

1. An electrical heating assembly (2) comprising: a glass-ceramic cooking plate (4) having an upper surface (6) for receiving a cooking vessel (8) and a lower surface (10); a radiant electric heater (12) incorporating at least one electric heating element (20), the heater (12) being supported in contact with the lower surface of the cooking plate (4); circuit means; and temperature sensing means (29) spaced above the at least one heating element (20), wherein the temperature sensing means (29) comprises: a support member (33) having provided on an upper surface thereof so as to contact the lower surface of the cooking plate (4) a temperature-sensitive electrical resistance element (30) of film form and provided with electrical connecting leads (34) arranged for electrical connection to said circuit means, said circuit means being constructed to monitor the electrical resistance of the film form temperature-sensitive electrical resistance element (30) as a function of temperature of the shielded region of the lower surface (10) of the cooking plate (4) with which it is in contact and hence as a function substantially of temperature of a cooking vessel (8) located on the upper surface (6) of the cooking plate (4) and overlying the shielded region; and thermal insulation means (40) adapted and arranged to shield the support member (33) and a corresponding region of the lower surface (10) of the cooking plate (4) from direct thermal radiation from the at least one electric heating element (20).

2. An assembly as claimed in claim 1, wherein the support member (33) comprises a high-temperature resistant material.

3. An assembly as claimed in claim 2, wherein the support member (33) comprises a ceramic material.

4. An assembly as claimed in claim 3, wherein the support member (33) is selected from alumina and cordierite.

5. An assembly as claimed in claim 1, wherein the support member (33) extends from a periphery of the heater (12) towards a central region thereof.

6. An assembly as claimed in claim 5, wherein the electrical connecting leads (34) are arranged to extend from the film form temperature-sensitive electrical resistance element (30) at least to a peripheral region of the heater (12).

7. An assembly as claimed in claim 1, wherein the support member (33) is provided in a central region of the heater (12).

8. An assembly as claimed in claim 1, wherein the support member (33) is supported from below.

9. An assembly as claimed in claim 1, wherein the electrical connecting leads (34) are of film form.

10. An assembly as claimed in claim 9, wherein the electrical connecting leads (34) are provided on the upper surface of the support member (33).

11. An assembly as claimed in claim 1, wherein the film form component (30) is of thick film form.

12. An assembly as claimed in claim 11, wherein the film form component (30) is screen-printed and fired onto the upper surface of the support member (33).

13. An assembly as claimed in claim 11, wherein the thick film component comprises an electrically conductive phase selected from platinum, gold, silver, palladium, nickel and alloys thereof.

14. An assembly as claimed in claim 1, wherein the film form component (30) is of thin film form.

15. An assembly as claimed in claim 14, wherein the film form component (30) is sputtered onto the upper surface of the support member (33).

16. An assembly as claimed in claim 14, wherein the thin film component comprises platinum.

17. An assembly as claimed in claim 1, wherein the thermal insulation means (40) is of a form selected from pad and block form in contact with the support member (33).

18. An assembly as claimed in claim 17, wherein the thermal insulation means (40) is provided with a shallow recess for accommodating the support member (33).

19. An assembly as claimed claim 1, wherein the thermal insulation means (40) is secured to the lower surface of the support member (33).

20. An assembly as claimed in claim 1, wherein the thermal insulation means (40) is selected from vermiculite, microporous, ceramic fibre and calcium silicate materials.

21. An assembly as claimed in claim 1, wherein the thermal insulation means (40) has an external surface (44) provided with a layer of thermal radiation-reflecting material.

22. An assembly as claimed in claim 1, wherein the radiant electric heater (12) comprises a dish-like support (14) accommodating the at least one electric heating element (20) and having a peripheral wall (18) of thermal insulation material contacting the lower surface (10) of the glass-ceramic cooking plate (4).

23. An assembly as claimed in claim 22, wherein the support member (33) passes through a recess formed in the upper surface of the peripheral wall (18).

24. An assembly as claimed in claim 22, wherein the support member (33) is secured to the dish-like support (14).

25. An assembly as claimed in claim 24, wherein the support member (33) is secured to the dish-like support (14) by way of a mounting bracket (31) secured to the side of the dish-like support (14).

26. An assembly as claimed in claim 1, wherein an electrically insulating layer is provided on the upper surface of the support member (33).

27. An assembly as claimed in claim 26, wherein the electrically insulating layer is of film form.

28. An assembly as claimed in claim 1, wherein a temperature-responsive means (46) is additionally provided to sense temperature of a region of the glass-ceramic cooking plate (4) subjected to direct thermal radiation from the at least one electric heating element (20) and adapted to de-energise the at least one electric heating element (20) when a predetermined maximum operating temperature is reached by the cooking plate (4).

29. An assembly as claimed in claim 9, wherein the film form leads (34) are of thick film form.

30. An assembly as claimed in claim 29, wherein the film form leads (34) are screen-printed and fired onto the upper surface of the support member (33).

31. An assembly as claimed in claim 29, wherein the thick film leads (34) comprise an electrically conductive phase selected from platinum, gold, silver, palladium, nickel and alloys thereof.

32. An assembly as claimed in claim 9, wherein the film form leads (34) are of thin film form.

33. An assembly as claimed in claim 32, wherein the film form leads (34) are sputtered onto the upper surface of the support member (33).

34. An assembly as claimed in claim 32, wherein the thin film leads (34) comprise platinum.

35. An assembly as claimed in claim 1, wherein the thermal insulation means (40) is held in contact with the lower surface of the support member (33).

* * * * *